US006853152B2

(12) United States Patent
Pruett et al.

(10) Patent No.: US 6,853,152 B2
(45) Date of Patent: Feb. 8, 2005

(54) ELECTRIC POWER SUPPLY SAFETY INTERLOCK SYSTEM

(75) Inventors: Henry Frazier Pruett, Sandy, OR (US); Gerald E. Duffy, Portland, OR (US)

(73) Assignee: InFocus Corporation, Wilsonville, OR (US)

( * ) Notice: Subject to any disclaimer, the term of this patent is extended or adjusted under 35 U.S.C. 154(b) by 265 days.

(21) Appl. No.: 10/188,306

(22) Filed: Jul. 1, 2002

(65) Prior Publication Data

US 2003/0057849 A1 Mar. 27, 2003

Related U.S. Application Data

(62) Division of application No. 09/569,541, filed on May 12, 2000, now Pat. No. 6,424,097.

(51) Int. Cl.[7] ..... H05B 37/02

(52) U.S. Cl. ..... 315/219; 315/209 R; 315/362; 307/328; 307/140

(58) Field of Search ..... 315/200 R, 209 R, 315/219, 224, 246, 291, 362; 307/140, 142, 328; 361/71, 72

(56) References Cited

U.S. PATENT DOCUMENTS

| | | | | | |
|---|---|---|---|---|---|
| 4,093,366 | A | | 6/1978 | Hapke | 352/198 |
| 4,387,951 | A | | 6/1983 | Hall et al. | 439/299 |
| 4,455,509 | A | | 6/1984 | Crum et al. | 315/225 |
| 4,470,100 | A | | 9/1984 | Rebaudo et al. | 361/785 |
| 5,050,211 | A | * | 9/1991 | Dortu et al. | 379/438 |
| 5,084,653 | A | | 1/1992 | Nilssen | 315/219 |
| 5,117,178 | A | | 5/1992 | Roth | 315/291 |
| 5,166,579 | A | | 11/1992 | Kawabata et al. | 315/219 |
| 5,188,069 | A | * | 2/1993 | Fiorenza, II | 123/146.5 B |
| 5,205,753 | A | | 4/1993 | Butterfield et al. | 439/157 |
| 5,347,324 | A | | 9/1994 | Sasaki et al. | 348/789 |
| 5,410,112 | A | * | 4/1995 | Freeman | 200/50 A |
| 5,572,075 | A | * | 11/1996 | Campbell et al. | 307/328 |
| 5,670,846 | A | | 9/1997 | Hollaway | 315/151 |
| 5,676,442 | A | | 10/1997 | Fujimori | 353/119 |
| 5,855,488 | A | | 1/1999 | Heintz et al. | 439/310 |
| 6,034,485 | A | | 3/2000 | Parra | 315/209 R |
| 6,051,940 | A | | 4/2000 | Arun | 315/224 |

* cited by examiner

*Primary Examiner*—Don Wong
*Assistant Examiner*—Jimmy T Vu
(74) *Attorney, Agent, or Firm*—Schwabe, Williamson & Wyatt, P.C.

(57) ABSTRACT

A safety interlock apparatus for an electrical device includes a DC power supply, a ballast power supply including a ballast control circuit that controls a ballast power circuit, and a lamp. A relatively low voltage electrical connection is present between the DC power supply and the ballast control circuit. A relatively high voltage electrical connection is present between the lamp and the ballast power circuit. A safety interlock switch is positioned on the relatively low voltage electrical connection, the switch having a closed state wherein the relatively low voltage is supplied to the ballast control circuit and an open disconnected state wherein the relatively low voltage electrical connection is disconnected. A panel is fixable to the electrical device frame, and is selectively movable to expose the lamp for removal. The panel has a switch actuator positioned thereon operable to actuate the interlock switch to the open disconnected state when the panel is removed from the device, thereby disconnecting power to the ballast control circuit, which in turn immediately disables the ballast power circuit, rendering the lamp safe for removal.

9 Claims, 4 Drawing Sheets

ELECTRIC POWER SUPPLY SAFETY INTERLOCK SYSTEM

RELATED APPLICATIONS

This application is a division of U.S. patent application Ser. No. 09/569,541, filed May 12, 2000, now U.S. Pat. No. 6,424,097.

COPYRIGHT NOTICE

©2001 InFocus Corporation. A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR §1.71(d).

TECHNICAL FIELD

This invention relates to safety interlock devices and more particularly to an electromechanical interlock connector for supplying power to an arc lamp module and concurrently securing the arc lamp module within an image projector.

BACKGROUND OF THE INVENTION

There are previously known safety interlocking systems for protecting electrical equipment users and technicians against hazards, such as electrical shock, burns, radiation, and improper operating modes.

For example, it is well known to enclose a hazardous apparatus in a protective cage having an access door or panel, the removal of which actuates a safety interlock switch. Such a safety interlock switch typically removes primary power from the electrical equipment and must, therefore, be rated to carry primary currents and voltages.

In another example, some electrical equipment include a module that is removable for servicing or replacement. Often the removable module is secured behind or attached to an access panel. Typically, such removable modules are secured within the electrical equipment by mechanical fasteners and have separate electrical interconnections, safety interlock switches, and related wiring harnesses.

Portable image projectors present an interesting mix of requirements and hazards. Many such projectors employ a metal-halide or mercury vapor arc lamp that operates at a very high temperature, requires a high voltage pulse to ignite the are, must be readily replaceable, must be compact and lightweight, and must be packaged to protect users and the projector from heat, high voltage, and improper operating modes, such as operation of equipment at excessive temperatures, and high-voltage pulse generation during arc lamp replacement.

Portable image projectors are generally referred to as being "ultra-portable" if they are small enough and light enough to be carried by one hand. However, in order to safely manage the above-described arc lamp hazards, prior art safety interlock apparatus have generally been relatively heavy and bulky, rendering them undesirable for use in ultra-portable projectors.

One such conventional prior art safety interlock design is shown in FIG. 1. As indicated, a DC power supply 1A receives high voltage alternating current ("AC") line power from an electrical outlet along line 2A and provides positive direct current ("DC") voltage to a lamp ballast power supply 3A, which generates a ballasted voltage for lamp 5A. A safety interlock switch 7A is placed along AC line 2A upstream of the DC power supply. To shut down the projector for lamp removal or the like, switch 7A is automatically actuated by opening a lamp access panel to interrupt the high voltage line current along line 2A. Interruption of the line power eliminates power to the DC power supply 1A, ballast power supply 3A, and lamp 5A, thereby rendering the projector safe for lamp removal. While this prior art approach is effective, interruption of the relatively high voltage AC line power requires a relatively large, expensive safety interlock switch 7A. Such high voltage switch needs to be well insulated and have substantial contact spacing requirements (e.g., 3 mm) in order to prevent electrical arcing, both of which tend to increase the size, weight and cost of the switch 7A.

What is needed, therefore, is a compact, lightweight, inexpensive and safe safety interlock system that is suitable for use in portable and ultra-portable image projectors.

SUMMARY OF THE INVENTION

An object of this invention is, therefore, to provide a lamp apparatus that is suitable for use in portable and ultra-portable image projectors.

Another object of this invention is to provide a replaceable arc lamp module having a low power electrical safety interlock apparatus.

A further object of this invention is to provide a method for safely replacing an arc lamp in an image projector.

A safety interlock apparatus for an electrical device in accordance with this invention includes a DC power supply, a ballast power supply including a ballast control circuit that controls a ballast power circuit, and a lamp, all of which are housed within a frame. A relatively low voltage electrical connection is present between the DC power supply and the ballast control circuit. A relatively high voltage electrical connection is present between the lamp and the ballast power circuit. A switch is positioned on the relatively low voltage electrical connection, the switch having a closed state wherein the relatively low voltage is supplied to the ballast control circuit and an open disconnected state wherein the relatively low voltage electrical connection is disconnected. A panel is fixable to the frame to close the cavity within the frame, and selectively movable to expose the lamp for removal. The panel has a switch actuator operable to actuate the switch to the open disconnected state when the panel is removed from the device, thereby disconnecting power to the ballast control circuit, which in turn immediately disables the ballast power circuit, rendering the lamp safe for removal.

An advantage of this invention is that the switch, being connected to a relatively low voltage circuit, may be of compact and inexpensive design.

Another advantage of this invention is that when the panel is moved to expose the cavity, power is removed from the ballast, thereby preventing users from receiving electrical shocks.

Yet another advantage of this invention is that the switch and switch actuator design of the safety interlock circuit that "fails" in a safe, open-circuit condition.

Additional objects and advantages of this invention will be apparent from the following detailed description of preferred embodiments thereof that proceeds with reference to the accompanying drawings.

DETAILED DESCRIPTION OF PREFERRED EMBODIMENTS

Figure 2:
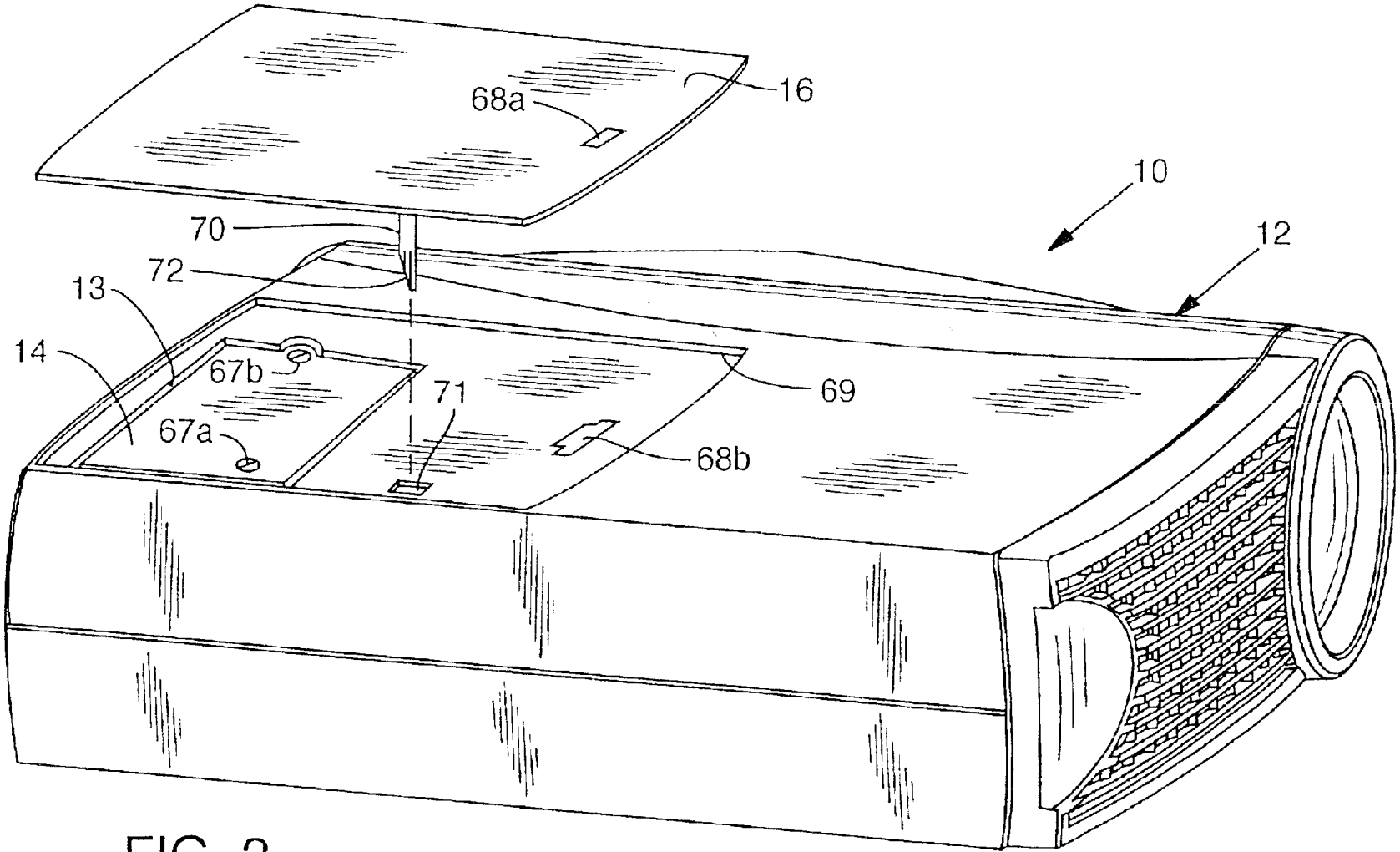
FIG. 2 is a front isometric view of an image projector in an inverted position showing a lamp access panel removed for lamp access.

FIG. 2 shows an image projector 10 (hereafter "projector 10") in an inverted position. Projector 10 comprises a housing 12 having a lamp module cavity 13, into which a lamp module 14 may be slidably removed or inserted. Cavity 13 is sized to closely mate with lamp module 14, thereby properly aligning and positioning lamp module 14 as it slides into or out of cavity 13. When fully inserted into cavity 13, lamp module 14 is covered by an access panel 16 that snaps into place. The present invention is directed to a safety interlock system that automatically eliminates lamp voltage upon removal of the access panel 16, thereby permitting safe access to the lamp module 14 for removal and replacement.

Figure 4:
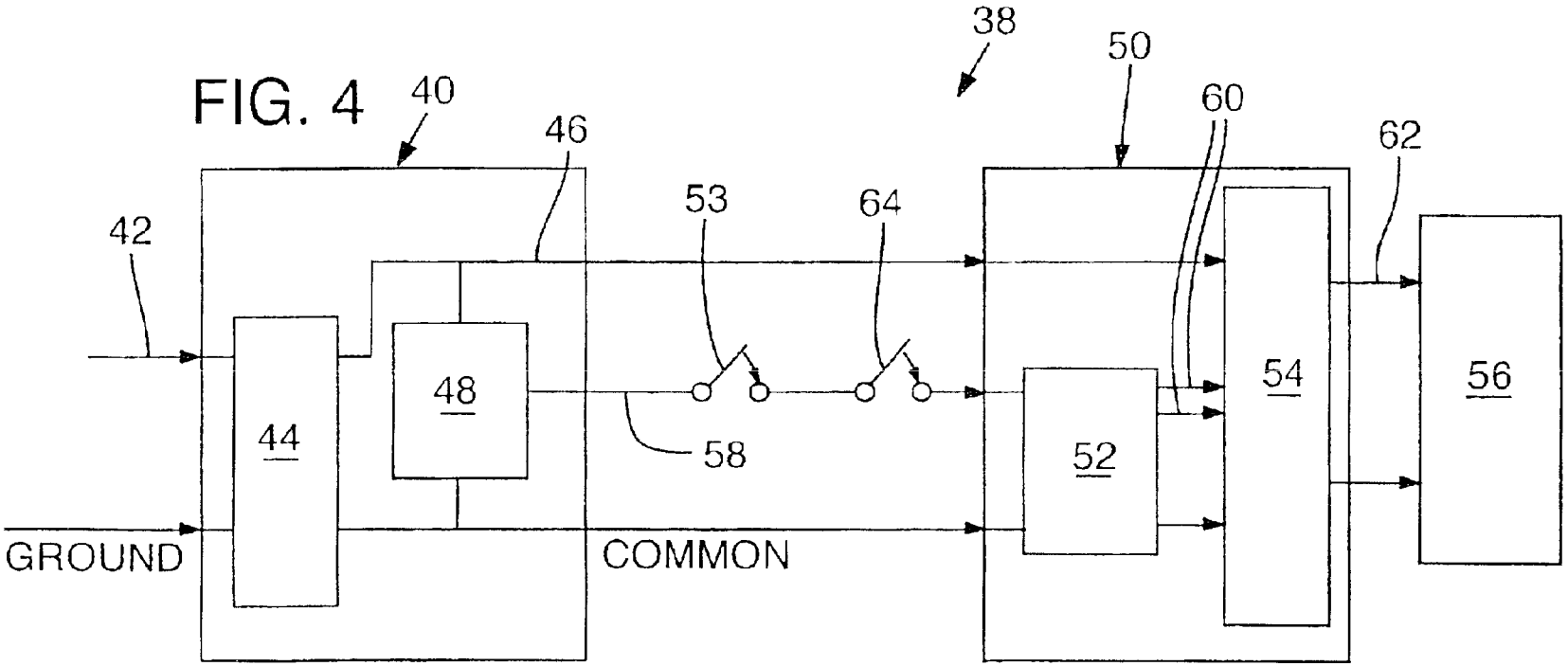
FIG. 4 is an electrical schematic diagram showing a preferred embodiment of a safety interlocking lamp interlock circuit of this invention.

FIG. 4 depicts the schematic electrical design of the present safety interlock system 38. A DC power supply 40 receives relatively high voltage alternating current line power (typically ranging from 100 to 230 V AC) from an electrical outlet along line 42. A bridge rectifier 44 receives the line power and produces relatively high DC voltage (around 300 V DC in the preferred embodiment). Such high DC voltage is supplied along line 46 to a flyback converter 48 positioned within the DC power supply, and to a lamp ballast power supply 50. Ballast power supply 50 includes a ballast control circuit 52 and a ballast power circuit 54, which generates a ballasted AC voltage for lamp 56.

The flyback converter 48 produces a relatively low DC voltage (around 12 V DC in the preferred embodiment) supplied along line 58 to ballast control circuit 52. A safety interlock switch 53 is located along line 58 to automatically cut the voltage to ballast control circuit 52 in the event of removal of the access panel 16 from the projector 10. Safety interlock switch 53 and its coupling to the access panel 16 are described in detail below.

Ballast control circuit 52 is electrically connected to and controls ballast power circuit 54 through line 60. Ballast power circuit 54 may be of conventional design and contains several semiconductor switches along with passive L, C, and R filters that receive the high voltage DC current from line 46. Ballast control circuit 52 is connected to such switches through a plurality of lines 60 and generates control signals to control the ballast power circuit switches. Such switches are operated in specific timing sequences in order to produce sufficient AC voltage through line 62 for the lamp in operation (around 85 V AC in the preferred embodiment) and the high voltage at lamp ignition (around 20 KV AC in the preferred embodiment). In the event that line 58 is broken by opening switch 53 (i.e., actuating the switch 53 to an open disconnected state), the control signals from ballast control circuit 52 are eliminated, which interrupts the sequenced switch operation in the ballast power circuit 54 and immediately eliminates the high voltage output 62 from the ballast power supply to the lamp 56, thereby rendering the projector 10 safe for removal of the lamp.

A thermal switch 64 may also be positioned adjacent the lamp module 14. Like operation of the safety interlock switch, thermal switch 64 is opened in the event of a pre-determined over temperature adjacent the lamp module to eliminate high voltage to the lamp 56.

In another embodiment, the safety interlock switch could be placed along line 60 to interrupt the control signals downstream of the ballast control circuit 52. Alternatively, the safety interlock switch could be placed directly within the ballast control circuit to interrupt control signal output.

The mechanical design of the preferred embodiment will now be described in detail. As shown in FIG. 2, lamp access panel 16 is secured to housing 12 by a snap latch with male and female portions 68*a*, 68*b*. Male portion 68*a* is formed in the access panel to provide a cavity on the outward facing surface of the access panel 16 and a male snap protrusion on the inward facing surface of the access panel. The male snap protrusion snaps into female portion 68*b*, which is a cavity formed in the housing 12. The cavity of the upper portion 68*a* is sized to receive a screwdriver or similar tool to facilitate access panel removal from the projector. The housing has a shallow depression 69 shaped to receive the access panel 16 to further register and secure the access panel to the projector 10. Lamp module 14 slides in and out of housing 12 along a direction defined by cavity 13, and is secured in place by fasteners such as screws 67*a*, 67*b* or the like.

Figure 1:
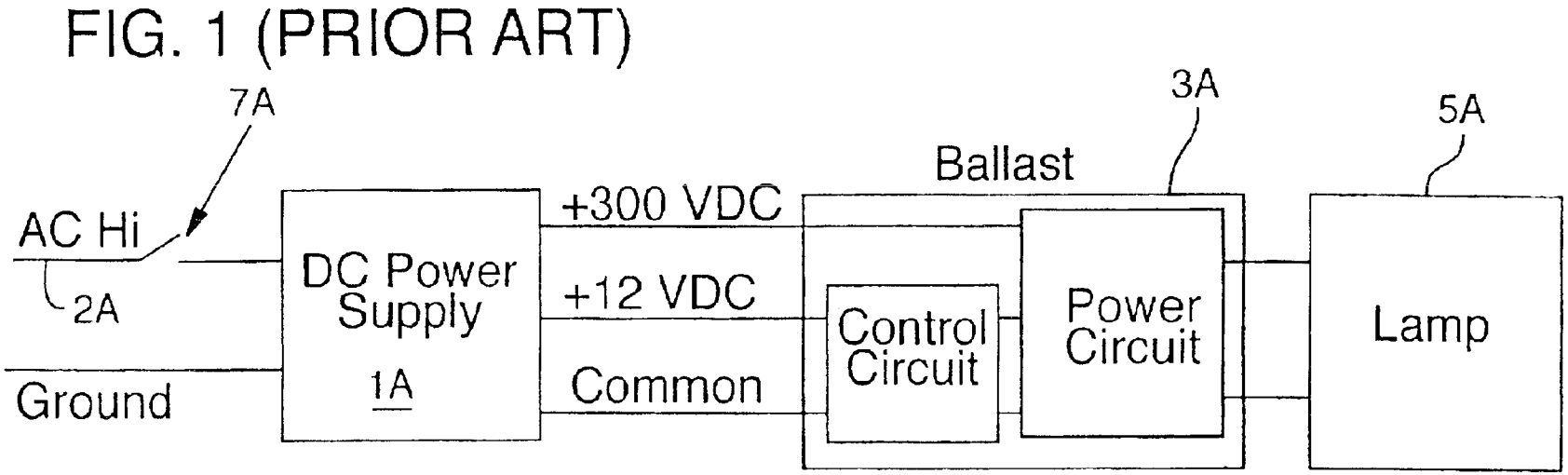
FIG. 1 (PRIOR ART)
FIG. 1 is an electrical schematic diagram showing a prior art embodiment of a safety interlocking lamp interlock apparatus.
Figure 3:
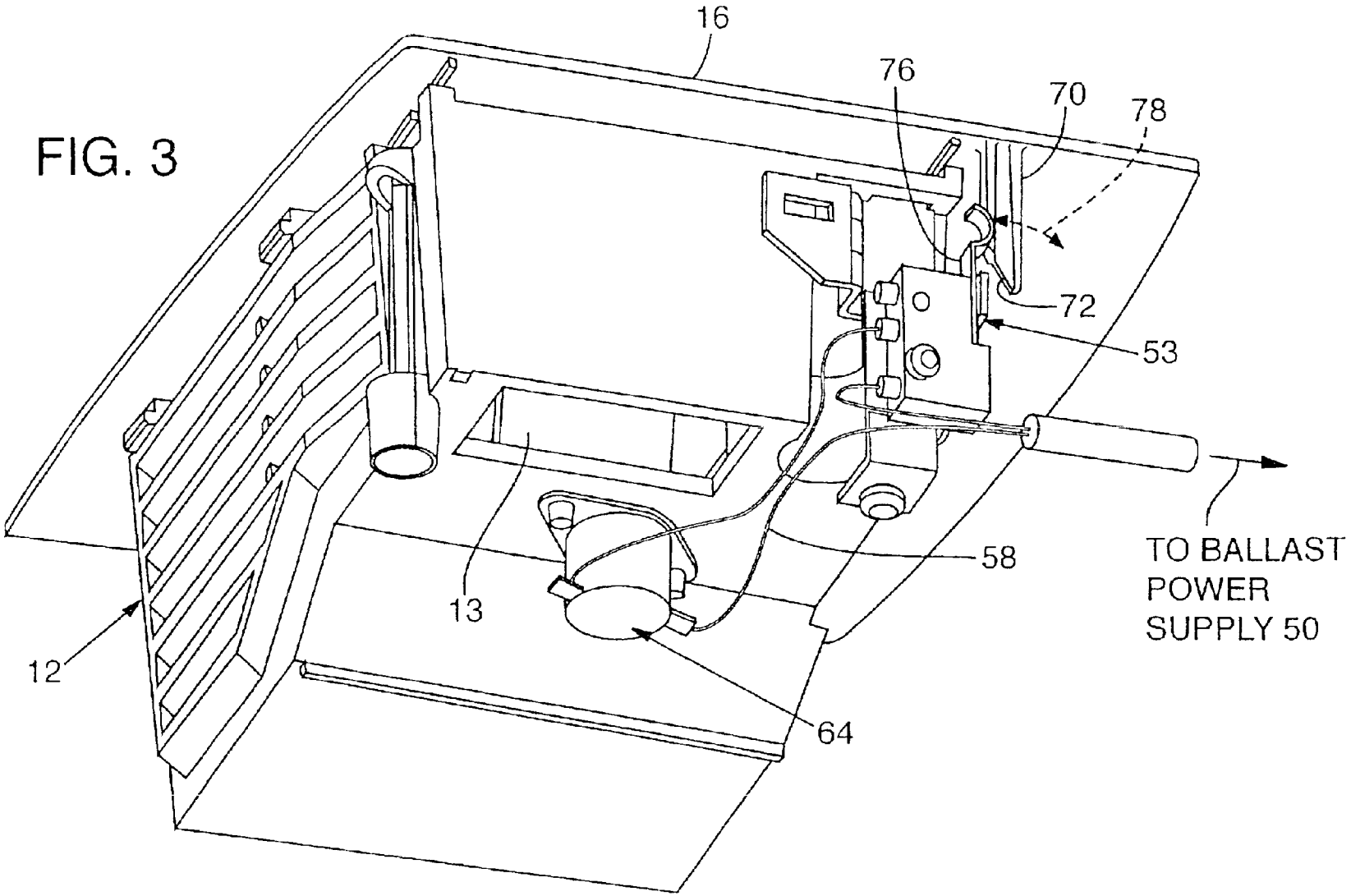
FIG. 3 is a rear isometric, cutaway view of an image projector in an inverted position showing portions of a safety interlocking lamp connector of this invention.

The safety interlock apparatus will now be described in detail by reference to FIGS. 1 and 3. A switch cavity 71 (see FIG. 2) is formed in the housing adjacent the lamp module 14. A safety interlock switch 53 (see FIG. 3) is mounted adjacent the lamp module cavity 13 at the distal end of switch cavity 71 within the housing 12. Access panel 16 has a switch actuator 70 extending therefrom that is received into cavity 71 when the access panel is placed over the lamp module 14 and snapped into place, as shown in FIG. 2. As best shown in FIG. 3, actuator 70 has a sloped cam surface 72 that couples with switch 53 when access panel 16 is installed on the housing 12.

Switch 53 includes a deflectable switch lever 76, which may be formed in a "question mark" shape to smoothly contact the cam surface 72 as the actuator moves into the cavity 71, which results in the switch lever 76 being deflected along direction 78 into a closed position to permit operation of the projector 10. FIG. 3 shows the switch 53 in such closed state. Correspondingly, removal of access panel 16 removes actuator 70 contact with the switch lever 76, whereby switch lever deflects along direction 78 (i.e. rightward in FIG. 3) into a disengaged open position wherein lamp power is interrupted and the projector is made safe for lamp removal. The open position is a default position so that power is interrupted to the lamp in any event that switch actuator 70 is removed from contact with switch lever 76.

In the present invention, since switch 53 breaks a relatively low voltage circuit 58, electrical arcing considerations are minimal. Thus, a small switch may be utilized without substantial contact spacing or stringent insulation requirements. As a result, the present switch 53 is smaller and less expensive than analogous switches in prior art safety interlock circuits. One preferred example of a switch 53 according to the present invention is a Model 311 SM5-T MicroSwitch from Honeywell Corp. A variety of other similar switches would also operate well with the invention.

One preferred ballast power supply is a model from OSRAM Sylvania, of Danvers, Mass. It is to be understood that the ballast power supply could be of numerous other makes and designs, so long as the relatively high voltage power circuit is controlled by a relatively low voltage control circuit. A preferred lamp is 120 watt high pressure mercury vapor lamp manufactured by OSRAM Sylvania of Danvers, Mass. It is to be understood that a variety of lamps of various designs and wattages may be applied to this invention, which will vary the voltage requirements of the DC power supply and ballast power supply systems.

As described, preferred DC power supply 40 incorporates flyback converter 48 to provide both relatively high voltage (300VDC) and relatively low voltage (12VDC) outputs. While flyback converter 48 is integrally designed into the preferred DC power supply 40 of the present invention, it is to be understood that separate DC power supplies may be employed, with each producing a respective high or low voltage output.

Removing lamp module 14 from projector 10 entails removing the power cord (not shown) from projector 10, ensuring that lamp module 14 is sufficiently cool to handle, removing the lamp module access panel 16 from projector 10, which automatically actuates the safety interlock switch 24 to ensure disengagement of power to the lamp 56 as described above. Lamp module 14, including lamp 56 and its prewired assembly may then be safely lifted out of the projector 10.

Installing a replacement lamp 56 in projector 10 entails installing lamp 56 and its prewired assembly in lamp module 14, sliding lamp module 14 into lamp cavity 13, securing the screw connectors 67*a*, 67*b*, and snapping lamp access panel 16 into place on the projector 10, and reinserting the power cord in projector 10.

Skilled workers will recognize that portions of this invention can be implemented differently from the implementation described above for a preferred embodiment. For example, the safety interlock of this invention may be applied to virtually any electrical apparatus requiring a removable module enclosing an electrical load. The switch may be of various different types and constructions.

It will be obvious to those having skill in the art that many changes can be made to the details of the above-described embodiments of this invention without departing from the underlying principles thereof. Accordingly, it will be appreciated that this invention is also applicable to safety interlock applications other than those found in image projectors. The scope of the present invention should, therefore, be determined only by the following claims.

What is claimed is:

1. A safety interlock system for an electrical device that includes a power supply and an electrical load, comprising:

a DC power supply and a ballast power supply, the ballast power supply including a ballast control circuit and a ballast power circuit, and the ballast control circuit producing control signals for delivery to the ballast power circuit to control its operation;

a relatively low voltage electrical connection between the DC power supply and the ballast power supply, the relatively low voltage electrical connection supplying a relatively low voltage for control of the operation of the ballast power supply; and a switch positioned in operative association with the ballast power supply to provide an interruptible low voltage electrical connection that controls production of the control signals or their delivery to the ballast power circuit, the switch having a first state in which the relatively low voltage electrical connection enables production and delivery of the control signals to and thereby enables power output from the ballast power supply to operate the electrical device, and the switch having a second state in which the relatively low voltage electrical connection does not enable production and delivery of the control signals to the ballast power circuit to interrupt power from the ballast power supply and thereby enable safe servicing of the electrical device.

2. A safety interlock apparatus for an electrical device that includes a power supply and an electrical load, comprising:

a frame;

a DC power supply, a ballast power supply including a ballast control circuit and a ballast power circuit, and a lamp housed within the frame, the ballast control circuit producing control signals for delivery to the ballast power circuit to control its operation;

a first electrical connection between the DC power supply and the ballast power supply, the first electrical connection including a relatively low voltage electrical connection supplying a relatively low voltage for control of the ballast power supply;

a second electrical connection between the lamp and the ballast power supply;

a switch positioned in operative association with the ballast power supply to provide an interruptible low voltage electrical connection that controls production of the control signals or their delivery to the ballast power circuit, the switch having a state in which the relatively low voltage electrical connection enables production and delivery of the control signals to and thereby enables power output from the ballast power circuit, and a second state in which the relatively low voltage electrical connection does not enable production and delivery of the control signals to and thereby disables power output from the ballast power circuit; and a panel fixable to the frame, the panel being selectively movable to open the frame for lamp access, the panel having a switch actuator operable to actuate the switch from the first state to the second state when moved to open the frame, thereby disabling power output from the ballast power circuit to the lamp.

3. The interlock system of claim 1, in which the electrical device is an image projector, the electrical load is a replaceable lamp, and the ballast power circuit provides electric power to the lamp.

4. The interlock system of claim 1, further comprising a thermal switch that is actuated in response to an overtemperature condition associated with the electrical device, the thermal switch being in electrical series connection with the switch to interrupt power from the ballast power supply.

5. The interlock system of claim 1, in which the DC power supply comprises a flyback converter that produces the relatively low voltage connection supplying a relatively low voltage for control of the operation of the ballast power supply.

6. The interlock system of claim 1, in which the switch is positioned to provide an interruptible electrical connection between the DC power supply and the ballast power supply.

7. The interlock system of claim 6, in which the DC power supply comprises a flyback converter and the switch is positioned to provide an interruptible electrical connection between the flyback converter and the ballast control circuit.

8. The interlock apparatus of claim 2, further comprising a lamp module in which the lamp is installable, the lamp module being configured for insertion into or removal from the frame.

9. The interlock apparatus of claim 8, in which the panel is positioned to provide access to and sufficient clearance for the lamp module to facilitate its removal from the frame.

* * * * *

UNITED STATES PATENT AND TRADEMARK OFFICE

CERTIFICATE OF CORRECTION

PATENT NO. : 6,853,152 B2
APPLICATION NO. : 10/188306
DATED : February 8, 2005
INVENTOR(S) : Henry Frazier Pruett et al.

It is certified that error appears in the above-identified patent and that said Letters Patent is hereby corrected as shown below:

In the Detailed Description of Preferred Embodiments:

Col. 3, line 47 "…line 60. "…" should read --…lines 60.--;

Col. 3, line 63, "…output 62…" should read --…output line 62…--;

Col. 4, line 2, "…pre-determined…" should read --…predetermined…--;

Col. 4, line 5, "…line 60…" should read --…lines 60…--;

Col. 4, lines 17-18, "…upper portion 68a…" should read --…male portion 68a…--;

Col. 4, line 54, "…circuit 58,…" should read --…circuit line 58,…--;

Col. 5, lines 19-20, "…safety interlock switch 24…" should read --…safety interlock switch 53…--;

Col. 5, line 26, "…lamp cavity 13…" should read --…lamp module cavity 13…--.

Signed and Sealed this

Twelfth Day of September, 2006

JON W. DUDAS
*Director of the United States Patent and Trademark Office*